US008371162B2

(12) United States Patent
Miranda et al.

(10) Patent No.: US 8,371,162 B2
(45) Date of Patent: Feb. 12, 2013

(54) APPARATUS AND METHOD FOR TESTING A COMPRESSOR

(75) Inventors: Carlos Miguel Miranda, Greer, SC (US); Douglas Frank Beadie, Greer, SC (US)

(73) Assignee: General Electric Company, Schenectady, NY (US)

( * ) Notice: Subject to any disclaimer, the term of this patent is extended or adjusted under 35 U.S.C. 154(b) by 725 days.

(21) Appl. No.: 12/493,576

(22) Filed: Jun. 29, 2009

(65) Prior Publication Data

US 2010/0326183 A1 Dec. 30, 2010

(51) Int. Cl.
*G01M 19/00* (2006.01)

(52) U.S. Cl. ..... 73/168; 73/112.05

(58) Field of Classification Search ..... 73/112.05, 73/118.02

See application file for complete search history.

(56) References Cited

U.S. PATENT DOCUMENTS 3,943,891 A 3/1976 Kinugawa
4,164,033 A * 8/1979 Glennon et al. ..... 701/100
4,598,581 A * 7/1986 Brekke ..... 73/114.68
4,651,563 A * 3/1987 Zweifel ..... 73/112.01
5,168,753 A * 12/1992 Arndt et al. ..... 73/168
5,517,852 A * 5/1996 Woodason et al. ..... 73/112.05
5,775,092 A * 7/1998 Hines ..... 60/791
6,027,304 A * 2/2000 Arar et al. ..... 415/116
6,220,086 B1 * 4/2001 Andrew et al. ..... 73/112.06
7,069,137 B2 6/2006 Miller

* cited by examiner

*Primary Examiner* — Hezron E Williams
*Assistant Examiner* — Mark A Shabman
(74) *Attorney, Agent, or Firm* — Dority & Manning, P.A.

(57) ABSTRACT

A test device for a compressor has a valve and ducting connected to the valve. A flow nozzle connected to the ducting has a corresponding coefficient of flow. A pressure sensor connected to the flow nozzle measures a pressure of a working fluid, and a flow rate of the working fluid is calculated using the pressure and the coefficient of flow. A method for testing a compressor includes operating the compressor at a first power level, measuring a flow rate of a working fluid at the first power level, adjusting a pressure of the working fluid to equal a first predetermined pressure, and measuring operating parameters of the compressor at the first power level. The method also includes adjusting the pressure of the working fluid to equal a second predetermined pressure and measuring operating parameters of the compressor at the first power level with the pressure of the working fluid at the second predetermined pressure.

13 Claims, 3 Drawing Sheets

APPARATUS AND METHOD FOR TESTING A COMPRESSOR

FIELD OF THE INVENTION

The present invention generally involves a test device for a compressor. More particularly, the present invention describes a calibrated flow control module for testing a compressor.

BACKGROUND

Compressors are widely used in gas turbines, jet engines, and various other industrial applications. A typical compressor includes multiple stages of aerofoils to progressively compress the working fluid. The multiple stages of aerofoils include rotating aerofoils, also known as blades or rotors, to accelerate the working fluid. Stationary aerofoils, also known as stators or vanes, decelerate and redirect the flow direction of the working fluid to the rotating aerofoils of the next stage. In this manner, the compressor produces a continuous flow of compressed working fluid for subsequent combustion and expansion to produce work.

Various devices exist to test the operational performance of compressors. For example, U.S. Pat. No. 6,220,086 describes a method and apparatus for testing the surge pressure ratio in compressors for turbines. The apparatus includes ducting that supplies the working fluid to the compressor inlet through a throttle valve. The position of the throttle valve is temporarily changed to briefly decrease the flow of working fluid into the compressor inlet during the testing.

The test device described in U.S. Pat. No. 6,220,086 does not include the ability to accurately measure the flow of working fluid into the compressor inlet. In addition, the test device does not include the ability to control the temperature of the working fluid prior to entry into the compressor inlet. Therefore, if the transient change in the flow of working fluid is not sufficient to perform the desired test, the process must be repeated, and the throttle valve must be temporarily changed to further briefly decrease the flow of working fluid into the compressor inlet to perform the desired test. Therefore, the test device may require a repetitive process to determine the correct throttle position to sufficiently reduce the flow of working fluid into the compressor inlet to perform the desired test.

Therefore, the need exists for a test device that can accurately deliver a desired flow of working fluid to a compressor for testing. In addition, the need exists for a test device that can increase the temperature of the working fluid prior to entry into the compressor inlet.

BRIEF DESCRIPTION OF THE INVENTION

Aspects and advantages of the invention are set forth below in the following description, or may be obvious from the description, or may be learned through practice of the invention.

In one embodiment of the present invention, a test device for a compressor includes a valve connected to the compressor and ducting connected to the valve. A flow nozzle connects to the ducting, and the flow nozzle has a corresponding coefficient of flow. A pressure sensor connected to the flow nozzle measures a pressure of a working fluid flowing through the flow nozzle, and a flow rate of the working fluid is calculated using the pressure of the working fluid and the coefficient of flow for the flow nozzle.

In another embodiment of the present invention, a test device for a compressor includes a valve connected to the compressor, and ducting connected to the valve. A flow nozzle connects to the ducting, and the flow nozzle has a corresponding coefficient of flow. Means for measuring a flow rate of a working fluid through the flow nozzle is connected to the flow nozzle.

The present invention also includes a method for testing a compressor. The method includes operating the compressor at a first power level, measuring a flow rate of a working fluid to the compressor at the first power level, and adjusting a pressure of the working fluid until the pressure of the working fluid entering the compressor equals a first predetermined pressure. The method further includes measuring operating parameters of the compressor at the first power level with the pressure of the working fluid entering the compressor at the first predetermined pressure. The method also includes adjusting the pressure of the working fluid until the pressure of the working fluid entering the compressor equals a second predetermined pressure and measuring operating parameters of the compressor at the first power level with the pressure of the working fluid entering the compressor at the second predetermined pressure.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION

Figure 1:
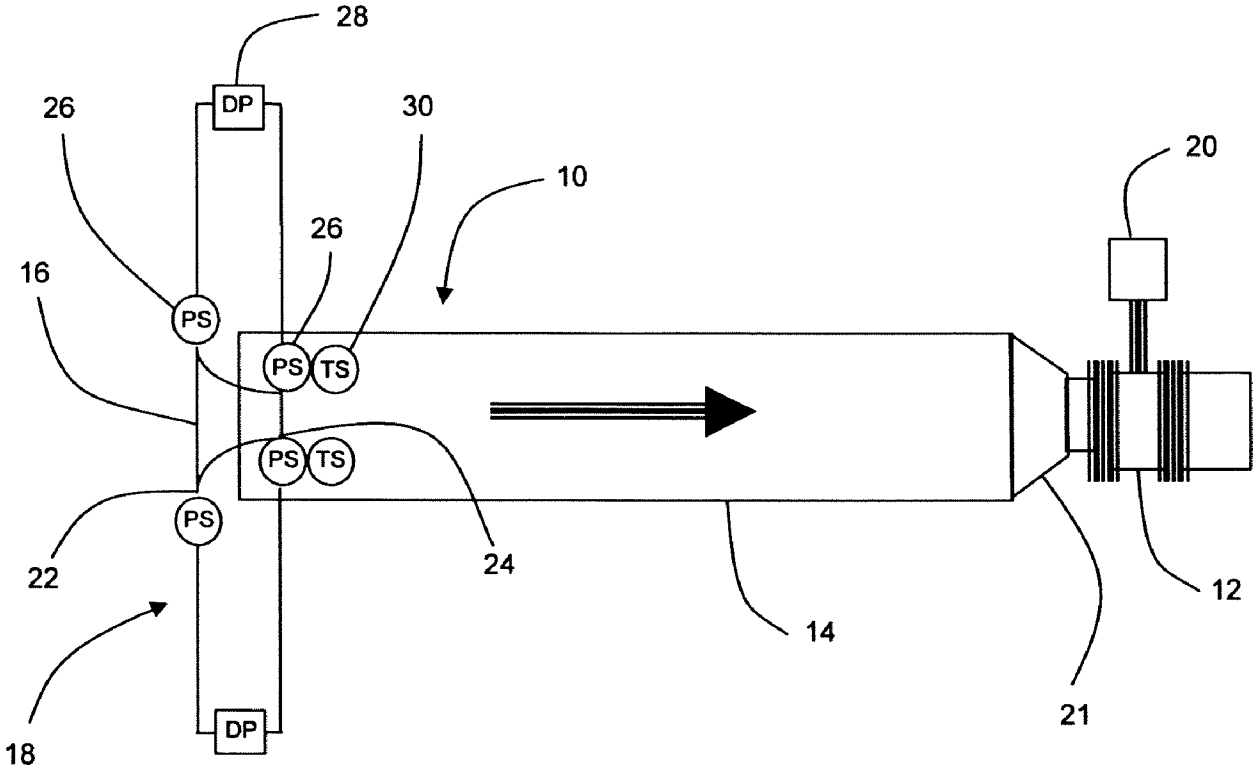
FIG. 1 is a simplified plan view of an embodiment of a flow control module that may be included in a compressor test device.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 provides a simplified plan view of an embodiment of a flow control module 10 that may be included in a compressor test device. As shown, the flow control module 10 generally includes a valve 12, ducting 14, a flow nozzle 16, and means 18 for measuring the flow rate of the working fluid through the flow nozzle 16.

The valve 12 may be any structure known to one of ordinary skill in the art for permitting and preventing flow. In particular embodiments, the valve 12 may also be capable of throttling to reduce the inlet pressure to the compressor being tested. For example, the valve 12 may be a globe valve, a throttle valve, a ball valve, a gate valve, a butterfly valve, or any equivalent structure. The particular type of valve selected will depend on operational factors, such as the anticipated flow rate, temperature, and/or inlet pressure at the compressor. For example, a 36 inch, flanged end, resilient seated butterfly valve is a suitable valve that permits sufficient flow of the working fluid, produces a minimal pressure drop across the valve, and provides a throttling capability.

The valve 12 may further include an actuator 20 for remote operation. The actuator 20 may be an electric motor, air motor, hydraulic motor, or any other equivalent device for remotely operating the valve 12.

The ducting 14 connects the flow nozzle 16 to the valve 12 and provides a flow path for the working fluid. The ducting 14 may be made of any suitable material, such as sheet metal, plastic, urethane, or polyvinyl chloride. The ducting 14 is sized to obtain a desired Beta ratio based on the ASME nozzle throat diameter. For example, suitable ducting 14 for a 24 inch ASME long radius flow nozzle and a desired Beta of 0.5 may have a 48 inch inner diameter. Additional fittings 21 may be necessary to connect the ducting 14 to the flow nozzle 16 or valve 12.

The flow nozzle 16 directs the flow of the working fluid into the ducting 14. The flow nozzle 16 generally includes an inlet 22 and a throat 24 through which the working fluid flows. A suitable flow nozzle 16 within the scope of the present invention may be a 24 inch ASME long radius flow nozzle.

The flow control module 10 is calibrated to accurately measure the flow rate of the working fluid through the flow nozzle 16, and thus into the compressor. Calibration of the flow control module 10 determines a flow coefficient (c) verses Reynold's Number (Rd) relationship for the flow control module 10.

The means 18 for measuring the flow rate of the working fluid may include one or more pressure sensors, differential pressure sensors, pitot tubes, impulse tubes, or similar devices known to one of ordinary skill in the art for measuring fluid flow. For example, the flow nozzle 16 may include one or more pressure sensors 26, such as an impulse tube, at the inlet 22 and throat 24 of the flow nozzle 16. The pressure sensors 26 may be used to generate a differential pressure signal 28 which may then be used with the flow coefficient to calculate the flow of the working fluid through the flow control module 10. The flow nozzle 16 may also include one or more temperature sensors 30 that measure the temperature of the working fluid so that the calculated flow rate may be adjusted for changes in temperature of the working fluid.

Figure 2:
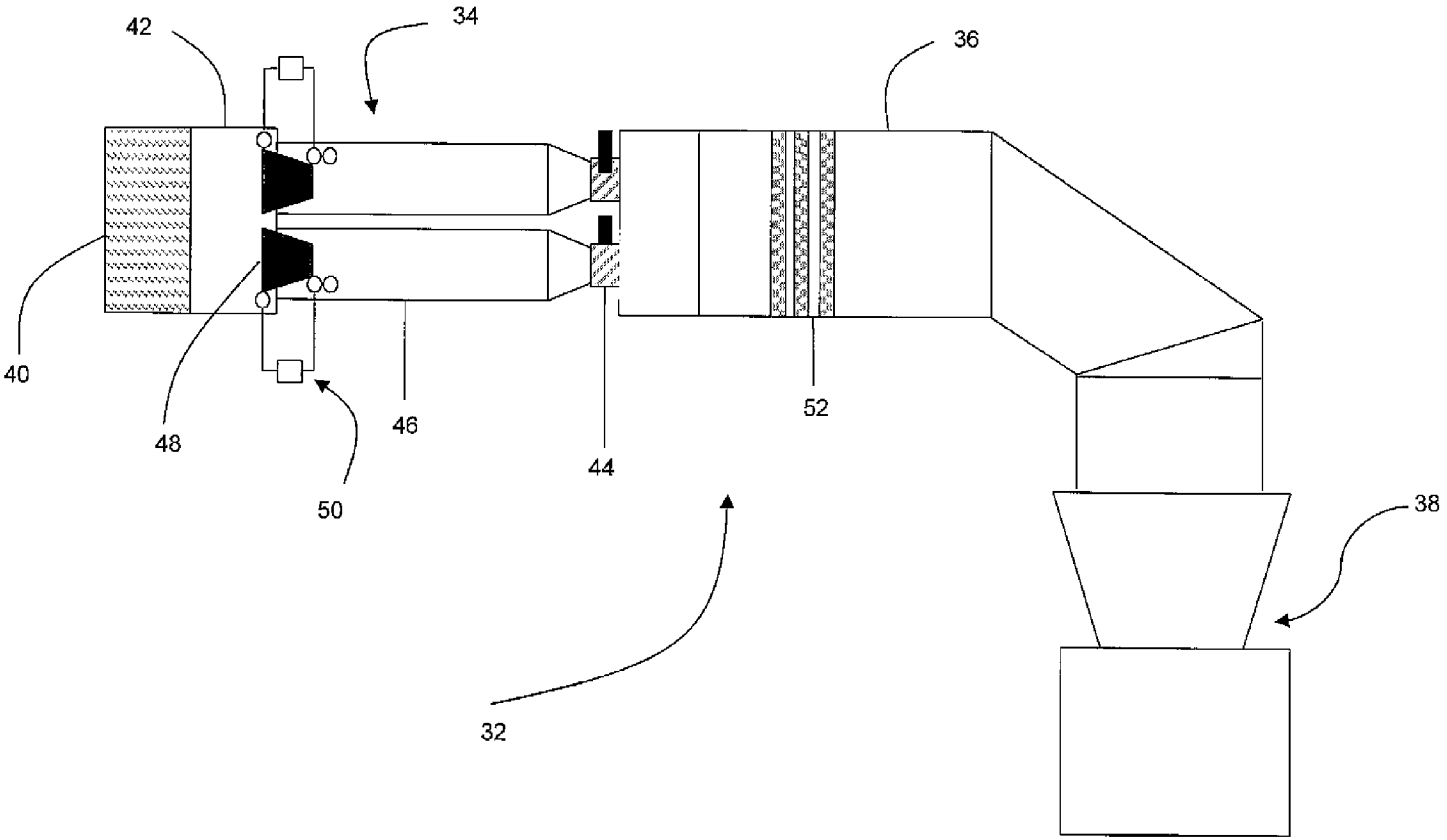
FIG. 2 is a simplified plan view of a test device according to one embodiment of the present invention.

FIG. 2 is a simplified plan view of a test device 32 according to one embodiment of the present invention. In this embodiment, the test device 32 includes multiple flow control modules 34 connected by a plenum 36 to a compressor 38. The actual number of flow control modules 34 in the test device depends on the flow requirements of the compressor being tested and can range from one to twenty-four or more. The total flow rate of the working fluid is calculated as the sum of the flow rates through each flow control module 34.

As shown in FIG. 2, the test device 32 may include a silencer 40 at the inlet to the flow control modules 34. The silencer 40 may include a screen, parallel baffle, muffler, or suitable equivalent structure known in the art for attenuating noise and/or preventing foreign objects from entering the test device 32. A silencer duct 42 connects the silencer 40 to the flow control modules 34.

Each flow control module 34 includes a valve 44, ducting 46, flow nozzle 48, and means 50 for measure flow rate as previously described with respect to FIG. 1.

The plenum 36 connects the flow control modules 34 to the compressor 38. The plenum 36 may be made of any suitable material, such as sheet metal, plastic, urethane, or polyvinyl chloride, and is sized to accommodate the desired flow rates anticipated for the compressor 38. The plenum 36 should be capable of withstanding pressure and vacuum changes caused by the compressor testing. For example, typical compressor testing may produce pressure transients of approximately 1.5 atmospheres and vacuum transients of 200 inches of water column in the plenum 36 downstream of the flow control modules 34.

The plenum 36 may include a baffle or perforated plates 52 to direct the flow of working fluid to attain the desired flow velocities downstream of the flow control modules 34. A suitable arrangement may include, for example, three staggered perforated plates 52 with a perforated area of approximately 48.5%.

Figure 3:
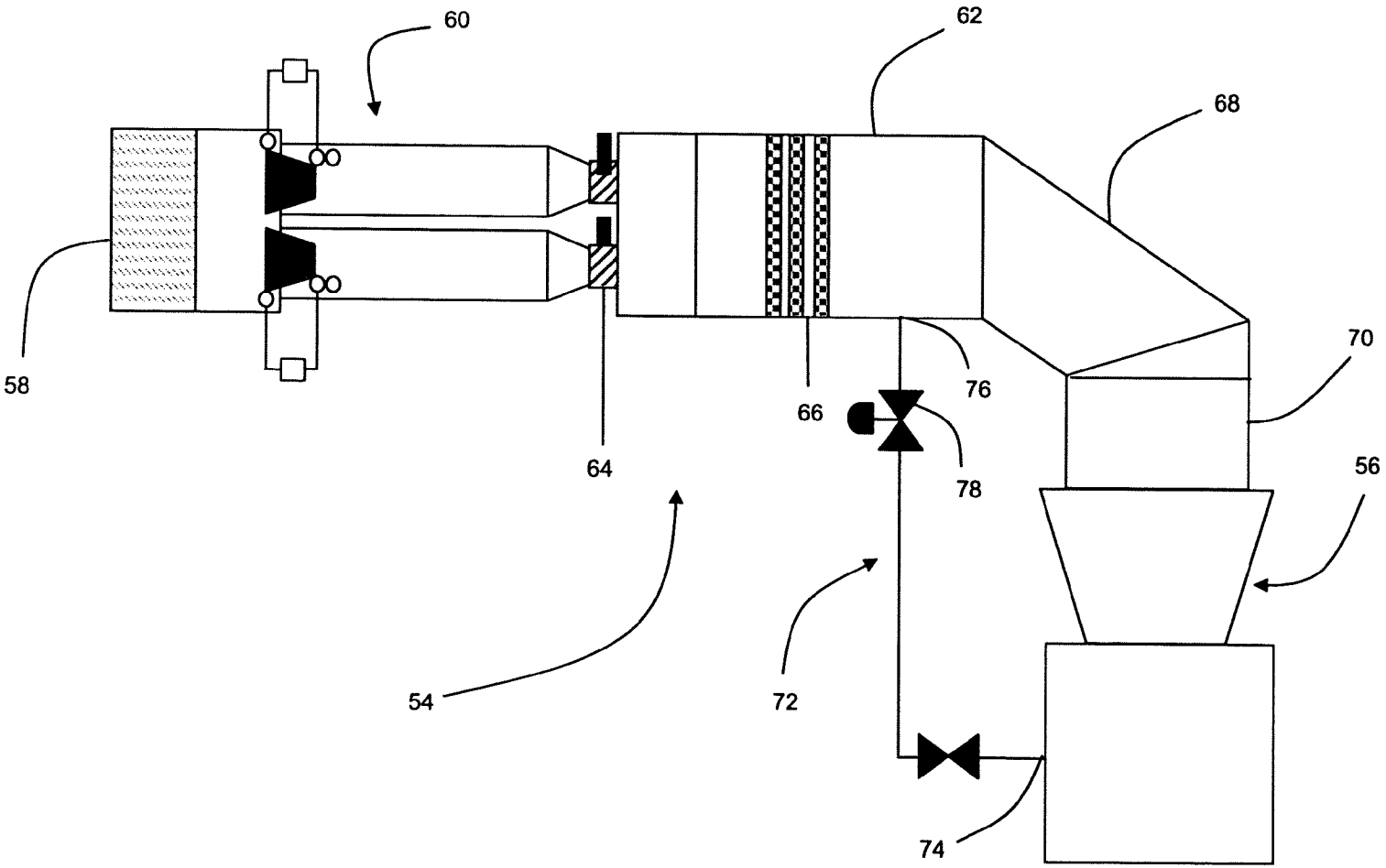
FIG. 3 is a simplified block diagram of a test device according to an alternate embodiment of the present invention.

FIG. 3 is a simplified block diagram of a test device 54 connected to a compressor 56 according to an alternate embodiment of the present invention. The test device 54 includes a silencer 58, one or more flow control modules 60, and a plenum 62 as previously discussed with respect to FIGS. 1 and 2. The working fluid flows through the silencer 58 to the flow control modules 60. The flow control modules 60 accurately measure the flow of the working fluid, and the positions of the valves 64 are adjusted to obtain the desired pressure of the working fluid at the inlet of the compressor 56 being tested. Perforated plates 66 in the plenum 62 direct the flow of working fluid to the compressor 56 through various elbows 68 and transition pieces 70 that connect the plenum 62 to the compressor 56.

The test device 54 shown in FIG. 3 further includes a bleed system 72 to heat the working fluid prior to entry into the compressor 56. A first end 74 of the bleed system 72 connects to the discharge of the compressor 56, and a second end 76 of the bleed system 72 connects to the test device 54. The bleed system 72 diverts a portion of the compressed and heated working fluid back to the test device 54, for example to the plenum 62 downstream of the flow control modules 60. The bleed system 72 may include a flow control valve 78 remotely operable to regulate the amount of diverted air supplied to the test device 54.

The test devices described in the present invention may be coupled to the inlet of a compressor to accurately measure the flow rate of the working fluid and adjust the pressure of the working fluid entering the compressor as the compressor operates at various power levels. For example, with the compressor operating at a first power level as required by a particular test, the test devices can accurately measure the flow rate of the working fluid to the compressor and adjust the valves until the pressure of the working fluid entering the compressor equals a first predetermined pressure. Operating parameters of the compressor, such as exhaust temperature, exhaust pressure, and compression ratio, may be measured and recorded at the first power level with the pressure of the working fluid at the inlet of the compressor at the first predetermined pressure. The test devices may then adjust the valves until the pressure of the working fluid entering the compressor equals a second predetermined pressure, and operating parameters of the compressor may again be measured and recorded.

The testing may then be repeated with the compressor operating at a second power level. As before, the test devices accurately measure the flow rate and adjust the pressure of the working fluid entering the compressor to third and fourth predetermined pressures to test the operating performance of the compressor. The third and fourth predetermined pressures may be the same as the first and second predetermined pressures, respectively.

During the compressor testing, the test device may further measure the temperature of the working fluid at the various power levels of the compressor. If the compressor test requires a particular temperature of the working fluid, the test device may further use the bleed system to heat the working fluid prior to entry into the compressor. Furthermore, the test device may pass the working fluid through perforated plates prior to entry into the compressor to regulate the flow of the working fluid into the compressor.

It should be appreciated by those skilled in the art that modifications and variations can be made to the embodiments of the invention set forth herein without departing from the scope and spirit of the invention as set forth in the appended claims and their equivalents.

What is claimed is:

1. A test device for a compressor, comprising:

a. a valve connected upstream from the compressor;

b. ducting connected to the valve;

c. a flow nozzle connected to the ducting upstream from the valve, the flow nozzle having a varying cross section and corresponding coefficient of flow; and d. a pressure sensor connected to the flow nozzle for measuring a pressure of a working fluid flowing through the flow nozzle, wherein a flow rate of the working fluid can be calculated using the pressure of the working fluid and the coefficient of flow for the flow nozzle.

2. The test device as in claim 1, further including a temperature sensor connected to the flow nozzle for measuring a temperature of the working fluid flowing through the flow nozzle.

3. The test device as in claim 1, further including a silencer upstream of the flow nozzle.

4. The test device as in claim 1, further including a baffle downstream of the valve.

5. The test device as in claim 1, further including a bleed system connected between the compressor and the test device for supplying heated working fluid to the test device.

6. The test device as in claim 1, wherein the valve is a throttle valve.

7. A test device for a compressor, comprising:

a. a valve connected upstream from the compressor;

b. ducting connected to the valve;

c. a flow nozzle connected to the ducting upstream from the valve, the flow nozzle having a varying cross section and corresponding coefficient of flow; and d. means for measuring a flow rate of a working fluid through the flow nozzle connected to the flow nozzle.

8. The test device as in claim 7, wherein the means for measuring a flow rate of a working fluid includes a pressure sensor for measuring a pressure of the working fluid flowing through the flow nozzle.

9. The test device as in claim 7, further including a temperature sensor connected to the flow nozzle for measuring a temperature of the working fluid flowing through the flow nozzle.

10. The test device as in claim 7, further including a silencer upstream of the flow nozzle.

11. The test device as in claim 7, further including a baffle downstream of the valve.

12. The test device as in claim 7, further including a bleed system connected between the compressor and the test device for supplying heated working fluid to the test device.

13. The test device as in claim 7, wherein the valve is a throttle valve.

* * * * *